US006869506B2

(12) United States Patent
Jewitt

(10) Patent No.: US 6,869,506 B2
(45) Date of Patent: Mar. 22, 2005

(54) APPARATUS FOR DEWATERING A PAPER WEB AND ASSOCIATED SYSTEM AND METHOD

(75) Inventor: Dennis Edward Jewitt, St. Marys Platt (GB)

(73) Assignee: Metso Paper Karlstad Aktiebolag (AB), Karlstad (SE)

( * ) Notice: Subject to any disclaimer, the term of this patent is extended or adjusted under 35 U.S.C. 154(b) by 17 days.

(21) Appl. No.: 10/302,050

(22) Filed: Nov. 22, 2002

(65) Prior Publication Data

US 2004/0099393 A1 May 27, 2004

(51) Int. Cl.[7] ..... D21F 5/02; D21F 5/18; D21F 5/20

(52) U.S. Cl. ..... 162/207; 162/290; 162/297; 162/376; 162/189; 34/122; 34/448; 34/452; 34/454; 34/86; 432/8; 432/59

(58) Field of Search ..... 162/189, 206, 162/207, 375–379, 359.1, 381, 290, 297, 201; 34/114, 115, 119, 122, 124, 125, 444, 448, 449, 452–454, 459, 513, 86, 604, 629; 432/8, 59, 60

(56) References Cited

U.S. PATENT DOCUMENTS

| | | | | | |
|---|---|---|---|---|---|
| 1,438,511 | A | * | 12/1922 | Witham, Jr. | 162/290 |
| 1,718,573 | A | * | 6/1929 | Milspaugh | 162/207 |
| 3,447,247 | A | * | 6/1969 | Daane | 34/122 |
| 3,879,858 | A | * | 4/1975 | Candor et al. | 34/452 |
| 4,074,441 | A | | 2/1978 | Helversen et al. | |
| 4,247,990 | A | | 2/1981 | Ohls et al. | |
| 4,481,722 | A | | 11/1984 | Guy et al. | |
| 5,225,042 | A | * | 7/1993 | Eaton et al. | 162/203 |
| 5,385,644 | A | * | 1/1995 | Hannus et al. | 162/207 |
| 5,553,392 | A | * | 9/1996 | Hanaya | 34/115 |
| 5,937,538 | A | | 8/1999 | Joiner | |
| 5,974,691 | A | * | 11/1999 | Marchal et al. | 34/456 |
| 6,080,279 | A | | 6/2000 | Hada et al. | |
| 6,199,296 | B1 | | 3/2001 | Jewitt | |
| 6,228,220 | B1 | | 5/2001 | Hada et al. | |
| 6,303,003 | B1 | | 10/2001 | Webster | |
| 6,306,257 | B1 | | 10/2001 | Hada et al. | |
| 6,306,258 | B1 | | 10/2001 | Lange et al. | |
| 6,331,230 | B1 | | 12/2001 | Hermans et al. | |
| 6,551,461 | B2 | * | 4/2003 | Hermans et al. | 162/207 |
| 6,742,280 | B1 | * | 6/2004 | Andren et al. | 34/358 |

FOREIGN PATENT DOCUMENTS

| | | |
|---|---|---|
| EP | 1 149 947 A2 | 10/2001 |
| WO | WO 03/012197 A2 | 2/2003 |

OTHER PUBLICATIONS

Smook, G. A., Handbook for Pulp and Paper Technologists, p. 261 (1992).*

* cited by examiner

*Primary Examiner*—Steven P. Griffin
*Assistant Examiner*—Eric Hug
(74) *Attorney, Agent, or Firm*—Alston & Bird LLP

(57) ABSTRACT

An apparatus for decreasing heat emission and enhancing a vacuum system in a papermaking machine is provided. Such an apparatus includes a drying device having an inlet for receiving heated air for removing moisture from a paper web and an outlet for exhausting the moisture-containing air from the drying device. A vacuum system is configured to produce a suction and receive the moisture-containing air. A web handling device is disposed upstream of the drying device and is configured to interact with the web before the web is directed to the drying device. The web handling device is further configured to receive a portion of the moisture-containing air from the drying device, wherein the portion of the moisture-containing air is directed through the web by the web handling device to facilitate dewatering of the web before the moisture-containing air is received by the vacuum system. The web handling device is also configured to provide the moisture-containing air at a supply pressure with respect to the suction produced by the vacuum system such that the web handling device operates at an above-ambient pressure. Associated apparatuses and methods are also provided.

74 Claims, 6 Drawing Sheets

APPARATUS FOR DEWATERING A PAPER WEB AND ASSOCIATED SYSTEM AND METHOD

BACKGROUND OF THE INVENTION

1. Field of the Invention

Figure 1A:
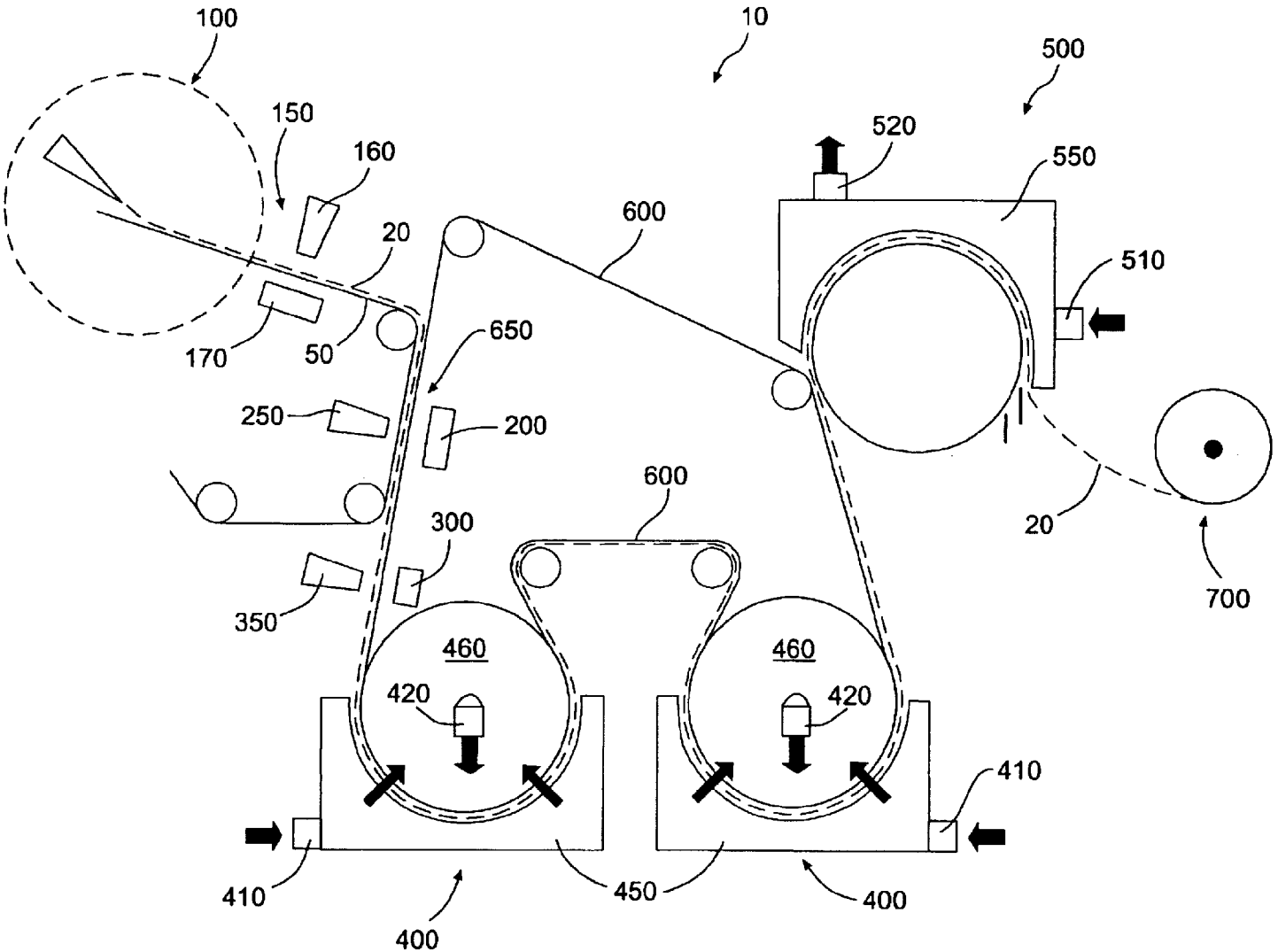

The present invention relates to papermaking machines and, more particularly, to papermaking machine configured to selectively recirculate exhaust air from a dryer so as to increase dewatering efficiency in processes upstream of the dryer, to reduce emissions from the papermaking machine, and to enhance a vacuum system associated with the papermaking machine.

2. Description of Related Art

Drying devices such as, for example, through-air dryers and Yankee dryers, are often employed in papermaking machines for drying a paper web after the paper web has been formed. Such drying devices often use a combination of heat and flowing air to dry the paper web and, as such, the exhaust from such drying devices comprises moisture-laden hot air. Generally, the venting of the exhaust from a drying device to atmosphere is undesirable for several reasons. For example, venting of the hot, moisture-laden air releases thermal energy that could be applied to other processes within the papermaking machine. Further, releasing the hot, moisture-laden air may increase undesirable papermaking plant emissions and may be unfavorably received by or may adversely affect neighbors surrounding the papermaking plant. In addition, significant and continuous environmental testing associated with the emissions may also be required. Accordingly, it would be desirable to reduce, minimize, or eliminate the emission of exhaust from such papermaking machine drying devices.

In some instances, the papermaking machine may be configured such that the exhaust from the drying device is recirculated through the drying device in order to reduce the heat input necessary to provide the heated air to the drying device, as well as to reduce emissions. In other instances, some of the exhaust from the drying device may be used to reduce process heat demands or to heat buildings. However, the heat from the exhaust of the drying devices often exceeds the amount of heat that can practically be re-used. In addition, a certain amount of the exhaust from the drying device must often be diverted so as to, for instance, remove excess condensates from the exhaust, wherein the exhaust may then be recirculated through the drying device. In such instances, though, the diverted portion may still be vented to atmosphere and thus will continue to undesirably contribute to plant emissions.

In order to reduce the amount of moisture to be removed from the web by the drying devices, many papermaking machines employ vacuum devices prior to the drying devices for partially dewatering the web. However, for example, in papermaking machines employing through-air dryers, it often undesirable to press or compact the web, though the web must still be dewatered to, for instance, about 18% to about 32% dryness. The vacuum devices thus employed to provide the necessary vacuum for dewatering the web to such an extent, and without pressing the web, often undesirably consume a significant amount of energy.

Thus, there exists a need for a papermaking machine having reduced emissions from the exhaust of the drying device(s). Further, it would be desirable for such a papermaking machine to have an efficient non-compacting (in the case of a machine employing a through-air dryer) dewatering process before the web is directed through the drying device(s). In addition, it would be desirable for the papermaking machine to exhibit reduced energy consumption with respect to the vacuum system and/or other high energy-consumption systems associated with the machine.

BRIEF SUMMARY OF THE INVENTION

The above and other needs are met by the present invention which, in one embodiment, provides an apparatus for decreasing heat emission and enhancing a vacuum system in a papermaking machine. Such an apparatus includes a drying device configured to dry a paper web, wherein the drying device has an air inlet for receiving heated air for removing moisture from the web and an air outlet for exhausting the moisture-containing air from the drying device. A vacuum system is configured to produce a suction and to receive the moisture-containing air. A web handling device is disposed upstream of the drying device and is configured to interact with the web before the web is directed to the drying device. The web handling device is further configured to receive a portion of the moisture-containing air from the air outlet of the drying device, wherein the portion of the moisture-containing air is directed through the web by the web handling device so as to facilitate dewatering of the web before the moisture-containing air is received by the vacuum system. The web handling device is also configured to provide the moisture-containing air at a supply pressure with respect to the suction produced by the vacuum system such that the web handling device operates at an above-ambient pressure.

Another advantageous aspect of the present invention comprises a method of decreasing heat emission and enhancing a vacuum system in a papermaking machine. The papermaking machine includes a drying device configured to dry a paper web, wherein the drying device has an air inlet for receiving heated air for removing moisture from the web and an air outlet for exhausting the moisture-containing air from the drying device, a web handling device disposed upstream of the drying device and configured to interact with the web before the web is directed to the drying device, and a vacuum system for producing a vacuum. A portion of the moisture-containing air from the air outlet of the drying device is directed to the web handling device, and through the web to the vacuum system, at a supply pressure with respect to the suction produced by the vacuum system such that the web handling device operates at an above-ambient pressure, so as to facilitate dewatering of the web.

Still another advantageous aspect of the present invention comprises an apparatus for increasing dewatering efficiency of a paper web in a papermaking machine. Such an apparatus includes a drying device configured to dry the web, wherein the drying device has an air inlet for receiving heated air for removing moisture from the web and an air outlet for exhausting the moisture-containing air from the drying device. An air handling device has an air inlet for receiving incoming air to be heated and an air outlet in communication with the air inlet of the drying device for directing the heated air thereto. A web handling device is disposed upstream of the drying device and is configured to interact with the web before the web is directed to the drying device. The web handling device is configured to receive a mixture of a portion of the heated air from the air outlet from the air handling device and a portion of the moisture-containing from the air outlet from the drying device for facilitating dewatering of the web, wherein the web handling device is further configured to interact with the web at an above-ambient pressure.

Yet another advantageous aspect of the present invention comprises a method of increasing dewatering efficiency of a paper web in a papermaking machine. The papermaking machine includes a drying device configured to dry a paper web, wherein the drying device has an air inlet for receiving heated air for removing moisture from the web and an air outlet for exhausting the moisture-containing air from the drying device. An air handling device has an air inlet for receiving incoming air to be heated and an air outlet for directing the heated air to the drying device, while a web handling device is disposed upstream of the drying device and is configured to interact with the web before the web is directed to the drying device. Accordingly, a portion of the moisture-containing air is first directed from the air outlet of the drying device, while a portion of the heated air from the air outlet of the air handling device is concurrently directed to be mixed therewith, before the mixture of air is directed to the web handling device. Thereafter, the mixture of air is directed through the web at the web handling device, the web handling device being operated at an above-ambient pressure, so as to facilitate dewatering of the web.

Thus, embodiments of the present invention meet the above-identified needs and provide significant advantages as detailed further herein.

BRIEF DESCRIPTION OF THE SEVERAL VIEWS OF THE DRAWING(S)

Figure 1B:
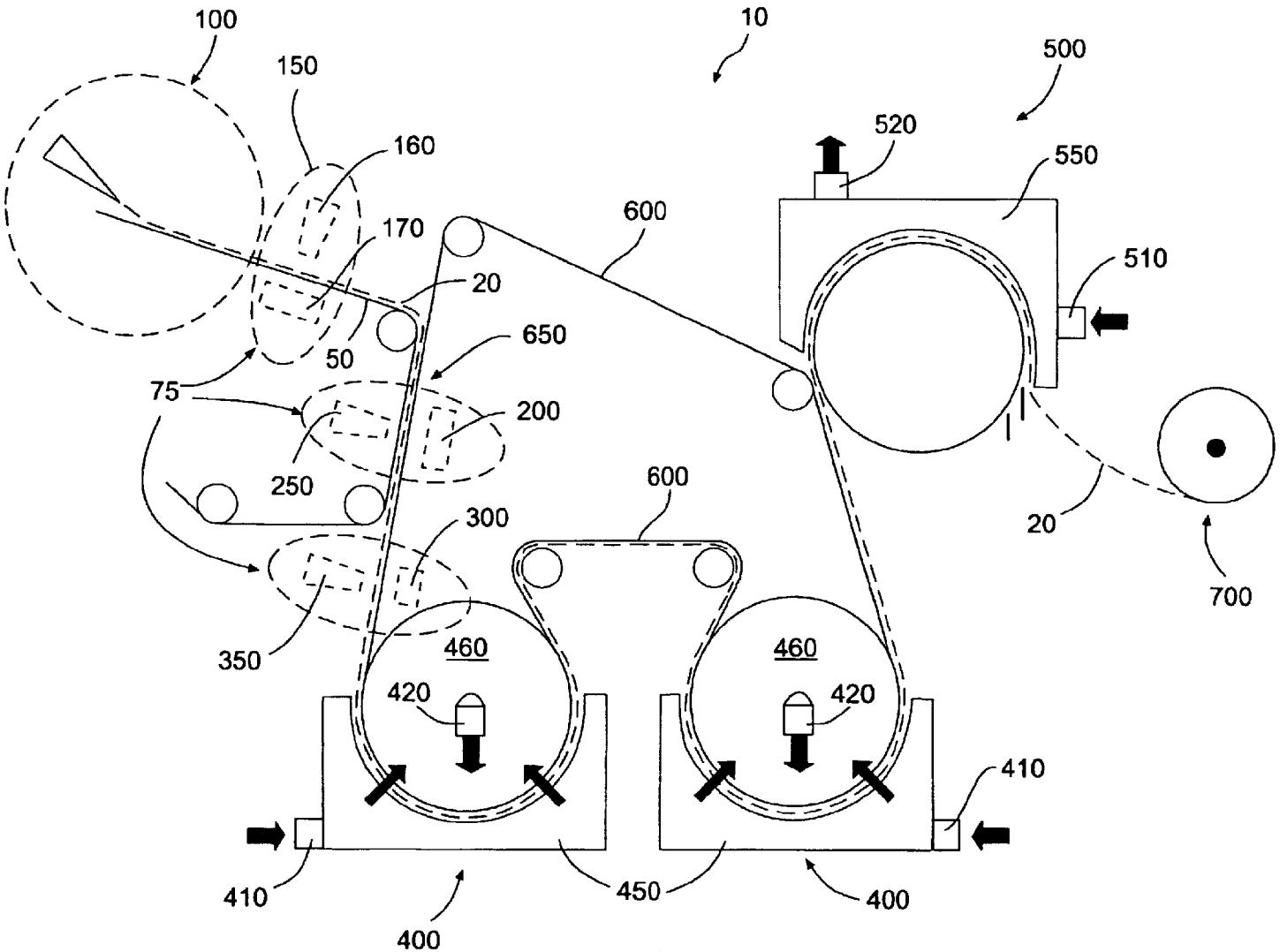
Figure 2:
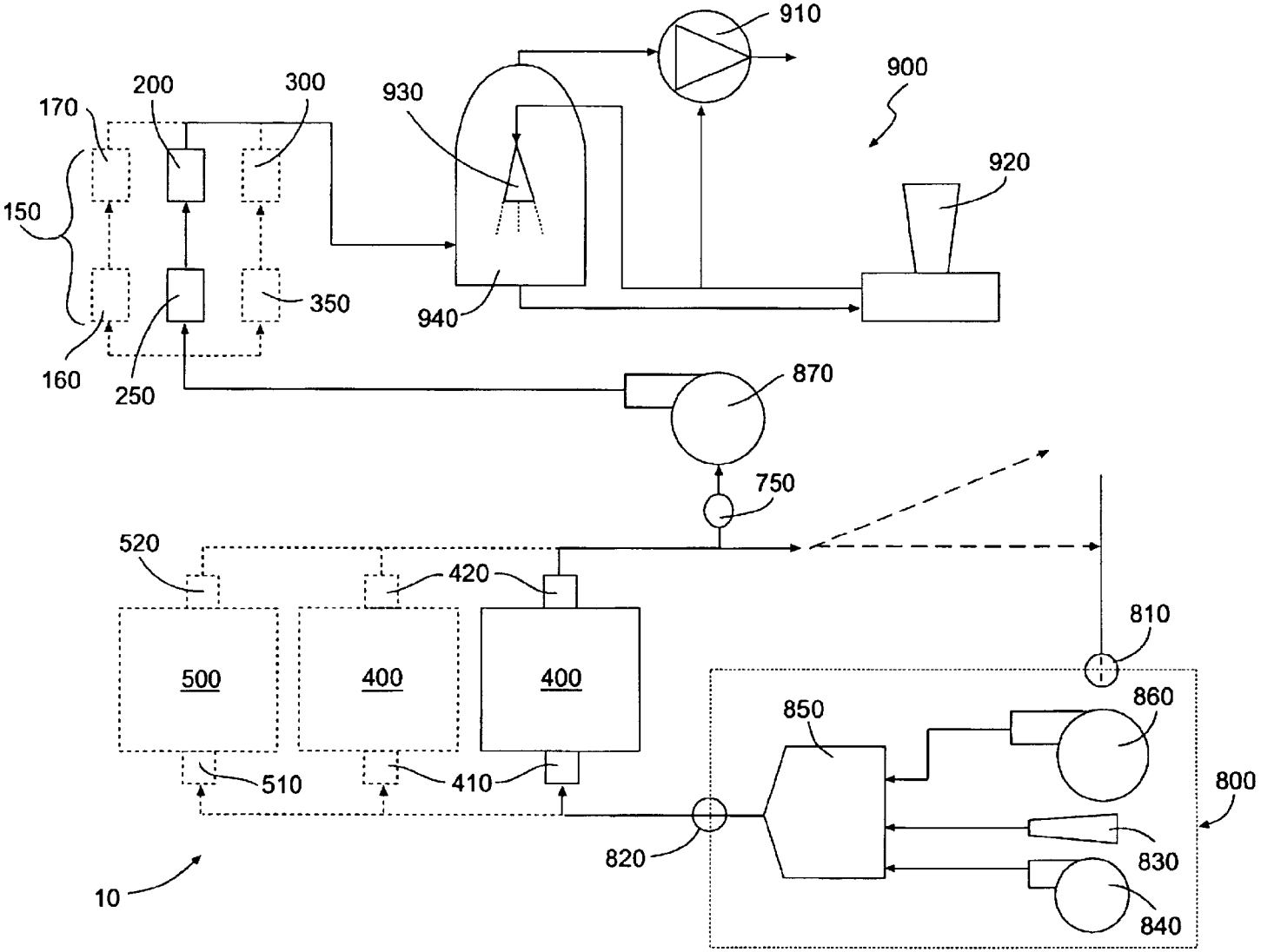
Figure 3:
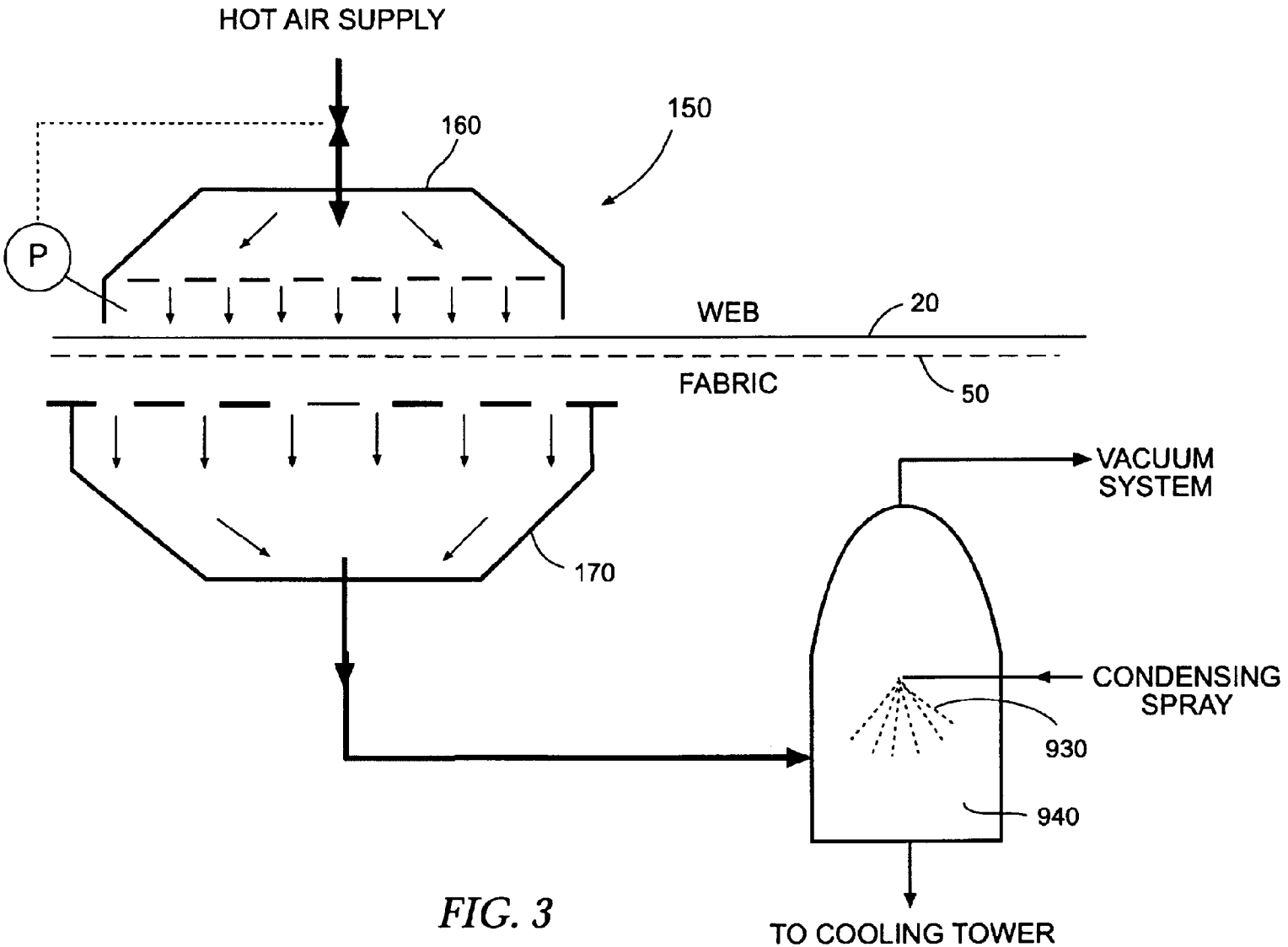
Figure 4:
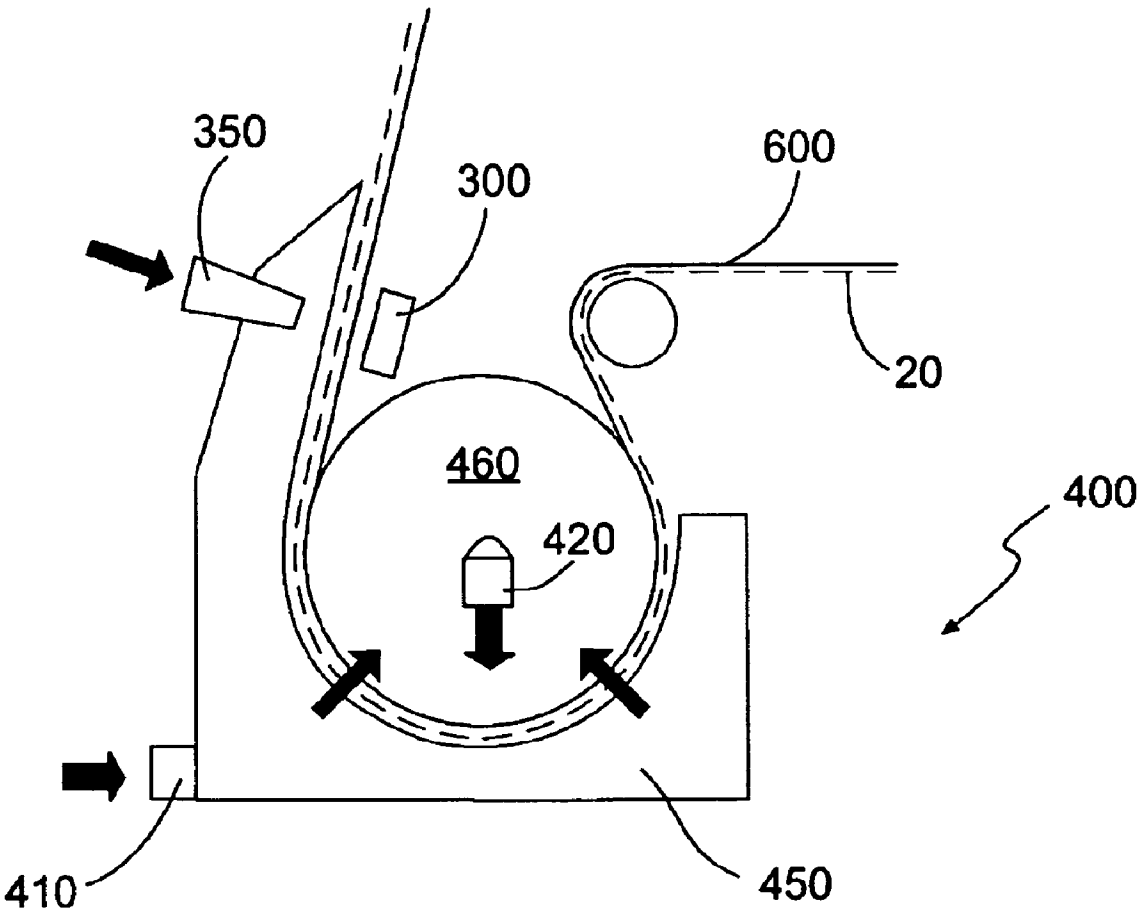
Figure 5:
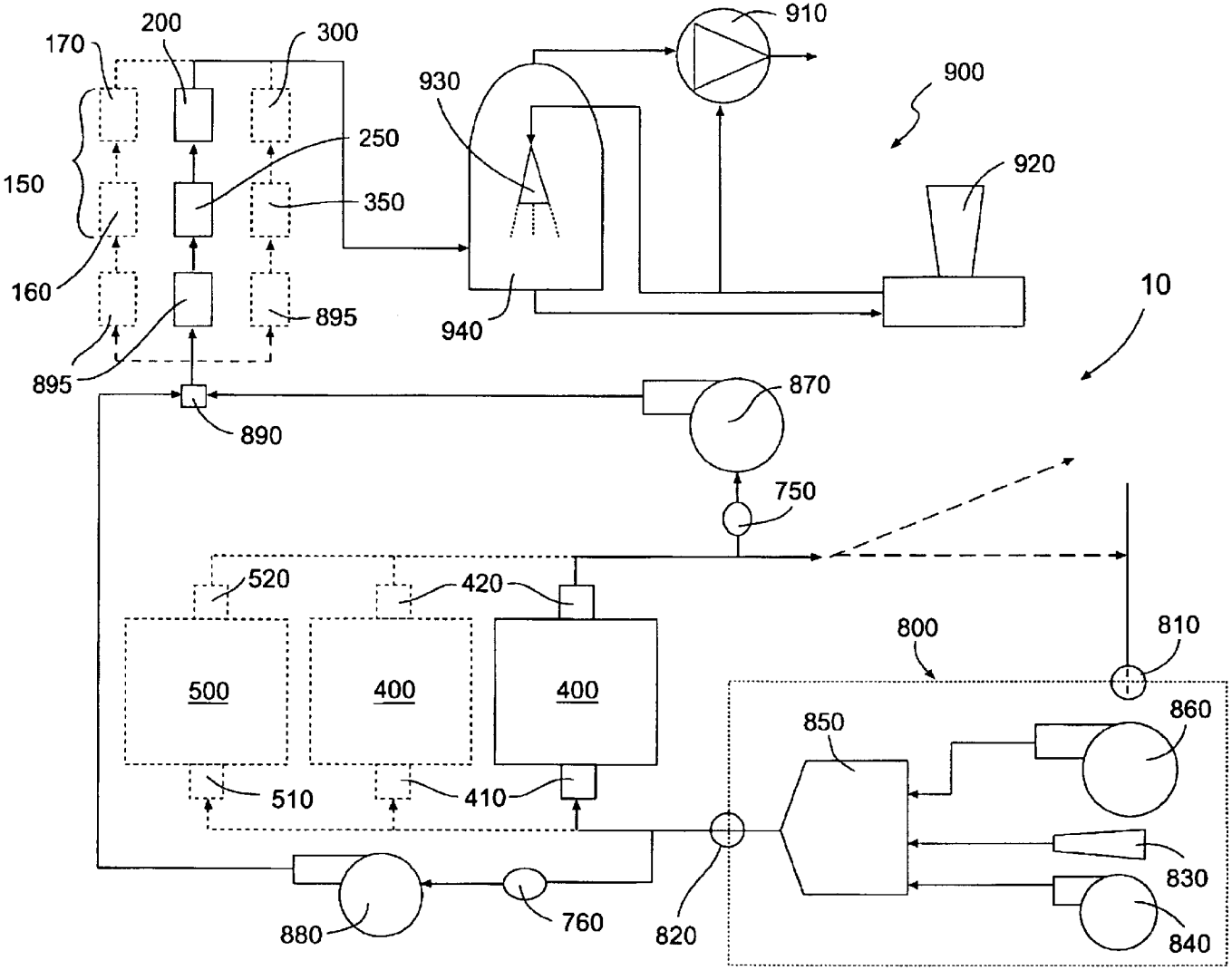

Having thus described the invention in general terms, reference will now be made to the accompanying drawings, which are not necessarily drawn to scale, and wherein:

FIGS. 1A–1B schematically illustrate alternative embodiments of a papermaking machine according to the present invention;

FIG. 2 is a schematic illustration of an air circulation system showing waste air from the drying devices being directed to upstream web handling devices, with a vacuum system in communication with a web handling devices, according to one embodiment of the present invention;

FIG. 3 is a schematic illustration of an air circulation system having a hot air supply device in association with a vacuum system, according to one embodiment of the present invention; and FIG. 4 is a schematic illustration of a through-air dryer showing a hood associated with the TAD extending over a vacuum box, with a blower extending into the hood opposite to the vacuum box, according to one embodiment of the present invention; and FIG. 5 is a schematic illustration of air circulation system showing a mixture of waste air from the drying devices and fresh hot air from an air handling device being directed to upstream web handling devices, with a vacuum system in communication with a web handling devices, according to one embodiment of the present invention.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 1A–1B illustrates an example of a papermaking machine according to one embodiment of the present invention, the papermaking machine being indicated generally by the numeral 10. Such a machine 10 includes a former 100 for forming a paper web 20 on a forming fabric 50. Such a machine 10 further comprises one or more drying devices such as, for example, an impingement dryer (not shown), a through-air dryer 400, and/or a Yankee dryer 500. The drying devices generally include a drying fabric 600 configured to receive the web 20 from the forming fabric 50 and to transport the web 20 through the through-air dryer(s) 400 to the Yankee dryer 500. In some embodiments, the drying fabric 600 may also comprise the forming fabric 50 in that the web 20 may be formed directly on the drying fabric 600, which may eliminate the forming fabric 50. At the Yankee dryer 500, the web 20 is separated from the drying fabric 600, dried by the Yankee dryer 500, creped from the Yankee dryer 500, and then directed to a reel-up 700. Note, however, that some embodiments may not include a Yankee dryer 500.

Generally, the web 20 may be dewatered, transferred between fabrics at various points between the former 100 and the drying devices, and otherwise handled by one or more various web handling devices 75. For example, after the web 20 is formed on the forming fabric 50 by the former 100, the web 20 may be directed through a hot air supply device 150 for dewatering the web 20. In some instances, where the web 20 is transferred from the forming fabric 50 to the drying fabric 600, a vacuum box 200 may be provided for facilitating transfer of the web 20 to the drying fabric 600. In still other instances, a molding box 300 may be disposed prior to the drying devices to structure the web 20, to provide additional dewatering of the web 20, to pre-heat the web 20 prior to the web 20 entering the drying device, and/or, for example, to provide a seal arrangement for a drying device as discussed, for example, in U.S. Pat. No. 6,199,296, also assigned to the assignee of the present invention and incorporated herein in its entirety by reference. One skilled in the art will appreciate, however, that web handling devices 75 such as the hot air supply device 150, the vacuum box 200, and the molding box 300 are only examples of the web handling devices 75 that may be disposed between the former 100 and the drying devices for dewatering the web 20 and that embodiments of the present invention may include any combinations of these devices and/or other dewatering or web handling devices 75. As will be described further herein, the hot air supply device 150, the vacuum box 200, and the molding box 300 are configured to require a suction for operation. Therefore, in some instances, the hot air supply device 150, the vacuum box 200, and the molding box 300 are configured to be operably engaged with a common vacuum system 900 (as shown in FIG. 2), though, in some cases, a separate vacuum system (not shown) may be provided for each device. FIG. 1B also shows the web handling devices 75 in phantom, indicating that embodiments of the present invention may include one or more such web handling devices 75 or any combinations thereof and, as such, it will be understood that embodiments of the present invention are neither restricted by the particular number or type of the web handling devices 75 which may be implemented therein.

As shown in FIGS. 1A, 1B, and 2, one embodiment of a papermaking machine 10 may include, for example, two consecutive through-air dryers (TADS) 400 and a Yankee dryer 500. Each TAD 400 and the Yankee dryer 500 may be supplied with air by a common air handling device 800, or in some instances, by separate air handling devices (not shown), wherein the air is typically heated by a heat source 850 and directed to the drying device by a fan 860. The heat source 850 may comprise, for example a direct gas-fired heater having a fuel inlet 830 and a combustion air fan 840, though many different types of direct and indirect heaters may be implemented to provide the necessary heat. The air handling device 800 generally takes in incoming air through an air inlet 810 and provides the air through an air outlet 820, wherein the air outlet 820 is configured to duct or channel the heated air to the drying devices. In the case of the Yankee dryer 500, the heated air is introduced into an air inlet 510 in the hood 550 of the Yankee dryer 500 and then exhausted through an air outlet 520 from the hood 550. The TAD 400, however, may be configured for either an inward flow or an outward flow, and one skilled in the art will appreciate that both configurations may be implemented herein within the spirit and scope of the present invention. For an inward flow TAD 400, as shown in FIG. 1, the heated air is supplied to an air inlet 410 in the hood 450 extending about the perforated drying cylinder 460, and then exhausted through an air outlet 420 extending from the drying cylinder 460 or, for example, an exhaust plenum extending across the dead zone of a single through-air dryer or between adjacent through-air dryers. Accordingly, for an outward flow TAD, the heated air would be supplied through an air inlet extending into the drying cylinder or an intake plenum extending across the dead zone of a single through-air dryer or between adjacent through-air dryers and then exhausted from an air outlet extending from the hood.

Note that, as shown in FIGS. 2 and 5, several of the drying devices 400, 500 are shown in phantom to reinforce that a papermaking machine 10 according to embodiments of the present invention may generally include one or more drying devices, such as an impingement dryer, a TAD, and a Yankee dryer, and the TAD 400 not shown in phantom is intended to indicate that the papermaking machine 10 may, in some instances, comprise a single drying device which may be, for example, the TAD 400, a Yankee dryer, an impingement dryer, or any other suitable dryer, or combinations thereof, consistent with the spirit and scope of the present invention. Likewise, several of the web handling devices 75 are shown in phantom to reinforce that a papermaking machine 10 according to embodiments of the present invention may generally include one or more web handling devices 75, such as hot air supply device 150, a vacuum box 200, and a molding box 300, and the vacuum box 200/blower 250 type of drying device 75 not shown in phantom is intended to indicate that the papermaking machine 10 may, in some instances, comprise a single web handling device 75 which may be, for example, the vacuum box 200, a hot air supply device 150, a molding box 300, or any other suitable web handling device, or combinations thereof, consistent with the spirit and scope of the present invention.

The exhaust air from each of the TAD 400 and the Yankee dryer 500 typically contains moisture extracted from the web 20 during the drying process. In addition, the exhaust air may still include a significant amount of thermal energy, though more so in the case of the exhaust air from the Yankee dryer 500. As such, in some instances, the exhaust air may be routed back to the air inlet 810 of the air handling device 800 for reheating by the heat source 850 and recirculation through the drying devices by the fan 860, as shown in FIG. 2, wherein the recirculation of the hot exhaust air may lower the power consumption requirements of the heat source 850. However, one skilled in the art will appreciate that such recirculation is not always implemented and, in other instances, the hot exhaust air may be used for other purposes or released to atmosphere. As such, in instances, where hot exhaust air recirculation is implemented, it would be disadvantageous to recirculate the moisture present in the exhaust air since this could lower the efficiency of the drying devices and, in some instances, may cause rewetting of the web 20. Accordingly, in either instance, a portion of the exhaust air, otherwise referred to as the waste air (indicated as element 750 in FIG. 2), is diverted from the air outlet(s) 420, 520 of the drying device(s) 400, 500. Thus, one advantageous aspect of the present invention involves directing the waste air 750 to the web handling devices 75, such as the hot air supply device 150, the vacuum box 200 and the molding box 300, so as to increase the dewatering efficiency thereof. In some situations, all, part, or none of the remainder of the exhaust air may be recirculated through the drying devices 400, 500 via the air handling device 800. Where all of the remainder of the exhaust air is recirculated through the drying devices 400, 500, substantially none of the exhaust air is vented to atmosphere, thereby advantageously reducing plant emissions, though recirculation of some of the remainder of the exhaust air will also advantageously reduce plant emissions as compared to releasing that exhaust air to atmosphere.

In one instance where the waste air 750 is directed to a web handling device 75, the web 20 is first formed by the former 100 on a forming fabric 50, which may comprise, for example, a Fourdrinier or forming wire, or a through-air drying (TAD) fabric. A hot air supply device 150 is disposed downstream of the former 100 and comprises a hot air supply hood 160 and a vacuum box 170. As a matter of background, some prior art air presses are configured to direct pressurized ambient temperature air through the web as it is sandwiched between two fabrics, such as shown, for example, in U.S. Pat. Nos. 6,331,230; 6,306,258; 6,306,257; 6,228,220; and 6,080,279. However, a hot air supply device 150 according to one embodiment of the present invention is configured for application with respect to a fabric, in some instances, only a single fabric. That is, in instances, where the web 20 is formed on a single forming fabric 50, the hot air supply hood 160 is disposed adjacent to the web 20 being transported thereby on the forming fabric 50, while the vacuum box 170 is disposed adjacent to the forming fabric 50, opposite the web 20, as shown in FIG. 3. Accordingly, only a single fabric is present in a hot air supply device 150 in some embodiments of the present invention. In such instances, the hot air supply hood 160 is configured to supply hot air, more particularly, the waste air 750, to the web 20, where the waste air 750 then is pulled through the web 20 and the forming fabric 50 by the suction from the vacuum box 170, and thus any moisture removed from the web 20 is collected by suction from the vacuum box 170. The vacuum box 170 is in communication with the vacuum system 900 which supplies the necessary suction. As with the web handling devices 75 discloses herein, the hot air supply device 150 is further configured to operate at close to and slightly above ambient pressure. That is, in instances where no suction is provided at the vacuum box 170, the supply pressure of the waste air 750 to the hot air supply hood 160 is adjusted such that the pressure in the hot air supply hood 160 is close to and slightly above ambient pressure. Thereafter, during operation of the hot air supply device 150, as the suction from the vacuum box 170 is increased, the supply pressure of the waste air 750 to the hot air supply hood 160 is also increased so as to maintain the pressure therein at close to and slightly above ambient pressure. As such, the effect is thereby to operate the web handling device 75, such as the hot air supply device 150, at a pressure close to and slightly above ambient.

The vacuum system 900 may comprise, for example, a liquid ring pump 910 employing a water source 920 such as, for example, a cooling tower, for providing the necessary seal water therefor, and a water spray source 930 disposed in a spray chamber 940 between the pump 910 and the vacuum box 170, the function of which will become more evident below. Thus, according to one advantageous aspect of the present invention, the waste air 750 from any single drying device or any combination or all of the drying devices may be directed to the hot air supply hood 160 of the hot air supply device 150, wherein the hot air supply hood 160 is configured to direct the waste air 750 through the web 20 and the forming fabric 50 for collection by the vacuum box 170. The waste air from a TAD 400 is typically in the range of about 25° C. to about 180° C., while the waste air from a Yankee dryer 500 is typically between about 250° C. to about 340° C. Thus, directing the heated moisture present in the waste air 750 from the drying devices through the web 20 generally decreases the viscosity of the water in the web 20, making the water more easily removed by the suction from the vacuum box 170, and thereby facilitating and increasing the efficiency of the dewatering process, while also preheating the web 20 for further downstream processes. This benefit provides a distinct advantage over double fabric air presses using pressurized ambient temperature air.

However, the waste air from the hot air supply device 150 collected by the suction from the vacuum box 170 may still contain a significant amount of thermal energy after it has been directed through the web 20, particularly when the waste air 750 is directed from the Yankee dryer 500 or a combination of both the Yankee dryer 500 and the TAD 400. According to one purpose of the present invention, this waste air preferably should not be vented to atmosphere. As such, the waste air is directed through the spray chamber 940 where the waste air interacts with a water spray provided by the water spray source 930. The water spray serves to condense a substantial amount of the moisture in the waste air while removing thermal energy therefrom, thereby cooling and volumetrically contracting or densifying the air. The water to the water spray source 930 may be provided by the cooling tower 920 or another water source, and the condensate collected from the waste air in the spray chamber 940 may be collected and returned to the cooling tower 920 where the thermal energy may be conveniently dissipated. The densified air further produces a pressure drop with respect to the waste air entering the spray chamber 940 and thus also reduces the required capacity of the pump 910 relative to instances in which ambient air is directed through the web handling device. This effect may be more significant where the thermal energy of the waste air 750 is greater, such as in instances where the air directed to the hot air supply device 150 is directed from the Yankee dryer 500. One skilled in the art, however, will appreciate that condensation of the moisture in the waste air and densification of the air may be accomplished in other manners. For example, in some instances, an increase in the flow of seal water to the pump 910 may provide the necessary condensation of the moisture in the waste air and the densification of the air at the pump 910. A vacuum system 900 configured in this manner provides, in some instances, an added benefit of removing particulate matter from the waste air, which may then be filtered from the cooling water returning to the cooling tower.

According to one embodiment of the present invention, after being transported through the hot air supply device 150, the web 20 may be transferred from the forming fabric 50 to the drying fabric 600 at a transfer area 650. Where the web 20 is transferred to the drying fabric 600, another web handling device 75 comprising, for example, a vacuum box 200, may be disposed adjacent to the drying fabric 600 for facilitating the transfer of the web 20 to the drying fabric 600. The vacuum box 200 operates with a suction provided thereto by the vacuum system 900. In such a configuration, the transfer area may further include a blower 250 disposed adjacent to the forming fabric 50 for directing air through the forming fabric 50 and through the web 20 so as to facilitate the transfer of the web 20 to the drying fabric 600 and to provide additional dewatering of the web 20. Thus, in another advantageous aspect of the present invention, the waste air 750 from the drying devices may also be directed through the blower 250, the forming fabric 50, the web 20, and the drying fabric 600, and to the vacuum box 200, so as to facilitate more efficient dewatering of the web 20 while also preheating the web 20, or maintaining the earlier preheating of the web 20, for further downstream processes. As previously discussed, in some embodiments, the vacuum box 200/blower 250 arrangement is configured to operate at a pressure of close to and slightly above ambient. Further, the waste air 750, after passing through the web 20, is collected by suction of the vacuum box 200 and then directed from the vacuum box 200 to the vacuum system 900. As such, the aforementioned advantage of condensing the moisture within the waste air, while densifying the air, so as to decrease the required capacity of the vacuum system 900, may also be realized.

In some instances, if necessary, embodiments of the papermaking machine 10 may further include a molding box 300 disposed adjacent to the drying fabric 600, prior to the drying devices, for further structuring and/or dewatering of the web 20. The molding box 300 may have a corresponding blower 350 disposed adjacent to the web 20, opposite the drying fabric 600, for directing air through the web 20 to assist in the dewatering process. Thus, in another advantageous aspect of the present invention, the waste air 750 from the drying devices may also be directed through the blower 350, the web 20, and the drying fabric 600, and to the molding box 300, so as to facilitate more efficient dewatering of the web 20 while also preheating the web 20, to structure the web 20, or to maintain the earlier preheating of the web 20, as the web 20 enters the drying devices. Also, as previously discussed, in some embodiments, the molding box 300/blower 350 arrangement is configured to operate at a pressure of close to and slightly above ambient. Further, the waste air 750, after passing through the web 20, is collected by the suction from the molding box 300 and then directed from the molding box 300 to the vacuum system 900. As such, the aforementioned advantage of condensing the moisture within the waste air, while densifying the air, so as to decrease the required capacity of the vacuum system 900, may also be realized.

According to a further advantageous aspect of the present invention, the hood 450 of the first TAD 400 may extend upstream of the drying cylinder 460 thereof so as to at least partially cover and oppose the molding box 300, as shown in FIG. 4. In such a configuration, the molding box 300 may comprise, for example, part of a sealing arrangement for a plenum extending across the dead zone of a single TAD or between the dead zones of adjacent TADs as described in commonly assigned U.S. Pat. No. 6,199,296. However, embodiments of the present invention may also have the blower 350 operably engaged with the hood 450 generally opposite to the molding box 300. The air handling device 800 supplies heated air through the heat source 850 at a temperature, for example, of about 225° C. to the TAD 400, wherein the through-air drying process is more efficient if the web 20 is at or about the temperature of the heated air upon entering the TAD 400. Accordingly, in some instances, the waste air 750 from the drying device(s) is directed to the blower 350 for pre-heating the web 20 to a desired temperature, immediately as the web 20 enters the TAD 400. That is, since the blower 350 is incorporated into the hood 450 and the web 20 passing by and being heated by the blower 350 immediately enters the TAD 400, the web 20 therefore enters the TAD 400 at the desired temperature. In such instances, the molding box 300/blower 350 arrangement is also configured to operate at a pressure of close to and slightly above ambient, further taking into account the heated air supplied to the hood 450.

FIG. 5 schematically illustrates another embodiment of a papermaking machine 10 according to the present invention. In some instances, the waste air 750 from the drying devices may not have the desired thermal energy for the upstream processes. Such a situation may occur when, for example, the machine 10 comprises only one or more TADs 400 and does not include a Yankee dryer 500. In such instances, a portion of the heated air (indicated as element 760 in FIG. 5) being directed from the air outlet 820 of the air handling device 800 to the air inlets of the respective drying devices, may be diverted and mixed with the waste air 750 from the drying devices so as to increase the thermal energy thereof. The flow of the diverted portion of the heated air 760, as well as the waste air 750 from the drying devices, may be controlled, for example, by appropriate fans 870, 880, dampers (not shown), and/or controllers (not shown). According to one embodiment of the present invention, the exhaust from the drying device(s) may be configured such that about 10% of the exhaust air is diverted as the waste stream 750 to the web-handling device(s). In another embodiment, the air outlet 820 of the air handling device 800 may be configured such that about 10% of the heated air 760 is diverted to the web handling device(s). The condition of the mixture of the waste air 750 from the drying device(s) and the portion of the heated air 760 from the air handling device 800 may, in some instances, be controlled by varying the flow of the respective streams. However, if necessary, the waste air 750 from the drying device(s), or the mixture of the waste air 750 from the drying device(s) and the portion of the heated air 760 from the air handling device 800, may be directed through a single conditioning device 890 (shown in phantom) for appropriately adjusting the condition of the air entering all of the web handling device(s) or, in some instances, through an individual conditioning device 895 for each web handling device, wherein each conditioning device 895 is configured to provide heated air having the appropriate condition for the respective web handling device 75.

A papermaking machine 10 configured according to embodiments of the present invention as described herein, in some instances, substantially eliminates emissions from the exhaust of drying devices that might normally be undesirably vented to atmosphere. Further, in some instances, an exhaust stack may be eliminated altogether, thereby simplifying construction and reducing the cost of environmental testing. In addition, losses internal to the machine 10 may also be controlled. For example, the supply of the waste air from the drying device(s) or, in some instances, the mixture of the waste air from the drying device(s) and the portion of the heated air from the air handling device 800, may be controlled so as to match or slightly exceed the capacity of the vacuum system 900. In this manner, seepage of room air into or excessive hot air leakage out of the web handling device(s) 75 can be avoided. Further, with respect to the drying device(s), pressure sensors (not shown) may, in some instances, be placed within the hood of the respective drying device so as to monitor the pressure therein. As such, the supply of the waste air from the drying device(s) or, in some instances, the mixture of the waste air from the drying device(s) and the portion of the heated air from the air handling device 800, may be controlled such that the pressure within the hood is maintained at approximately atmospheric pressure, and preferably slightly above ambient. Such a provision also facilitates the avoidance of seepage of room air into or excessive hot air leakage out of the drying device.

Thus, embodiments of the present invention may advantageously reduce or eliminate emissions due to the exhaust from the drying devices of a papermaking machine, thereby simplifying construction and reducing the need for environmental testing. Further, the enhancement of the web handling device(s) 75, for dewatering the web upstream of the drying device(s), with the supply of the waste air from the drying device(s) or, in some instances, the mixture of the waste air from the drying device(s) and the portion of the heated air from the air handling device 800, increases the heat transfer to the web 20, thus resulting in a more efficient and less energy-consuming dewatering process. In addition, particularly when high temperature air is directed to the web handling device(s) 75, a substantial reduction in the required capacity of the vacuum system 900 may also be realized.

In order to demonstrate the advantageous aspects of the present invention, a hot air supply device 150, having a hot air supply hood 160 as previously described, was implemented in a paper making machine 10 and operated at a slightly above-ambient pressure to prevent ingress of room air. The following process parameters were implemented:

| | |
|---|---|
| Product: | 20.5 $g/m^2$ towel base sheet |
| Wire Speed: | 1040 m/min |
| Vacuum Box Configuration: | 2 × 16 mm wide slots |
| Vacuum Box Suction Level: | 60 kPa |

The following results, consistent with the advantageous aspects of the present invention as described herein,were obtained:

| Air Supply Temp. (° C.) | Temp. in Vacuum Box (° C.) | Web Entering Temp. (° C.) | Web Temp. Rise (° C.) | Vacuum System Capacity Reduction (%) | Web Entering Dryness (%) | Web Dryness Increase (%) |
|---|---|---|---|---|---|---|
| 25 | 17.4 | 26.5 | −2.3 | Base | 25.5 | 1.7 |
| 161 | 24.1 | 27.0 | 4.9 | 7 | 25.6 | 1.9 |
| 262 | 28.5 | 28.3 | 9.2 | 12 | 26.3 | 1.9 |
| 330 | 30.8 | 29.8 | 10.5 | 17 | 25.7 | 2.3 |

Many modifications and other embodiments of the invention set forth herein will come to mind to one skilled in the art to which these invention pertain having the benefit of the teachings presented in the foregoing description and the associated drawings. For example, in some embodiments of the invention, the former may be configured to form the web on a single through-air drying fabric, wherein the single TAD fabric transports the web through the various web handling devices and the drying devices. Accordingly, in such instances, the forming fabric and the drying fabric are one in the same. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for decreasing heat emission and enhancing a vacuum system in a papermaking machine, said apparatus comprising:

a drying device comprising a Yankee dryer having a hood associated therewith, the Yankee dryer being configured to dry a paper web, the Yankee hood having an air inlet for receiving heated air for removing moisture from the web and an air outlet for exhausting the moisture-containing air from the drying device;

a vacuum system for producing a suction, the vacuum system being further configured to receive the moisture-containing air; and a web handling device disposed upstream of the drying device and configured to interact with the web before the web is directed to the drying device, the web being carried by a fabric, the web handling device being further configured to receive a portion of the moisture-containing air from the air outlet of the drying device comprising the Yankee dryer, the portion of the moisture-containing air being directed through the web by the web handling device so as to facilitate dewatering of the web before the moisture-containing air is received by the vacuum system through the fabric.

2. An apparatus according to claim 1 wherein the vacuum system is further configured to volumetrically contract the moisture-containing air while condensing the moisture therefrom, the volumetrically-contracted air thereby increasing the suction produced by the vacuum system.

3. An apparatus according to claim 2 wherein the vacuum system further comprises a liquid ring pump using a flow of seal water for producing the suction, and a cooling tower for conditioning the seal water.

4. An apparatus according to claim 3 wherein the cooling tower is further configured to supply water to a water spray device for emitting a water spray into engagement with the moisture-containing air from the web handling device, the water spray being configured to volumetrically contract the air while condensing the moisture therefrom.

5. An apparatus according to claim 3 wherein the moisture-containing air from the web handling device is directed through the liquid ring pump and the liquid ring pump is configured to use an increased flow of seal water to volumetrically contract the air while condensing the moisture therefrom.

6. An apparatus according to claim 1 wherein the drying device further comprises at least one of a through-air dryer and an impingement dryer.

7. An apparatus according to claim 1 wherein the web handling device comprises at least one of a vacuum box, a molding box, and a hot air supply device.

8. An apparatus according to claim 1 further comprising a former for forming the web on the fabric, the fabric comprising a forming fabric configured to transport the web through the web handling device, the web-handling device comprising a hot air supply device having a hot air supply hood and a vacuum box in communication with the vacuum system, the hot air supply device being configured such that the portion of the moisture-containing air from the air outlet of the drying device comprising the Yankee dryer is channeled by the hot air supply hood through the web, before the moisture-containing air is directed through the forming fabric and into the vacuum box.

9. An apparatus according to claim 8 wherein the forming fabric comprises a through-air drying (TAD) fabric.

10. An apparatus according to claim 1 wherein the fabric further comprises a drying fabric configured to receive the web from a forming fabric having the web formed thereon, and the web handling device comprises a vacuum box disposed adjacent to the drying fabric, the web handling device being configured such that the portion of the moisture-containing air from the air outlet of the drying device comprising the Yankee dryer is channeled through the forming fabric and through the web, before being directed through the drying fabric and into the vacuum box.

11. An apparatus according to claim 10 wherein the vacuum system is configured to be in communication with the vacuum box so as to provide suction thereto, the vacuum system being configured to provide sufficient suction to pull the moisture-containing air through the forming fabric, the web, and the drying fabric and into the vacuum box.

12. An apparatus according to claim 1 wherein the fabric further comprises a drying fabric configured to transport the web thereon to the drying device, the web handling device further comprising a molding box in communication with the vacuum system and disposed adjacent to the drying fabric, the web handling device being configured such that the portion of the air from the air outlet of the drying device comprising the Yankee dryer is channeled through the web, before being directed through the drying fabric and into the molding box.

13. An apparatus according to claim 12 wherein the drying device further comprises a through-air dryer having a drying cylinder at least partially covered by a hood and wherein the hood extends upstream of the drying cylinder so as to at least partially oppose the molding box, and wherein the portion of the moisture-containing air is directed from the air outlet of the drying device comprising the Yankee dryer into the hood, generally opposite to the molding box, such that the moisture-containing air is directed through the web and the drying fabric and into the molding box.

14. An apparatus according to claim 1 further comprising an air handling device for providing heated air to the drying device comprising the Yankee dryer for drying the web, the air handling device having an air inlet for receiving air to be heated and an air outlet in communication with the air inlet of the drying device comprising the Yankee dryer for directing the heated air to the drying device.

15. An apparatus according to claim 14 wherein the air handling device is further configured such that a portion of the heated air from the air outlet of the air handling device is mixed with the portion of the moisture-containing air from the drying device comprising the Yankee dryer and then channeled to the web-handling device.

16. An apparatus according to claim 15 wherein the portion of the air from the heated air outlet of the air handling device comprises about 10% of the heated air from the air outlet of the air handling device.

17. An apparatus according to claim 1 wherein the portion of the moisture-containing air comprises about 10% of the moisture-containing air from the air outlet of the drying device comprising the Yankee dryer.

18. An apparatus according to claim 1 further comprising a conditioning device for adjusting a condition of the portion of the moisture-containing air from the air outlet of the drying device comprising the Yankee dryer before channeling the portion of the moisture-containing air to the web handling device.

19. An apparatus according to claim 1 wherein the remainder of the moisture-containing air from the air outlet of the drying device comprising the Yankee dryer is recirculated through the drying device such that substantially none of the moisture-containing air from the drying device is vented to atmosphere.

20. A method of decreasing heat emission and enhancing a vacuum system in a papermaking machine, the papermaking machine including a drying device comprising a Yankee dryer having a hood associated therewith, the Yankee dryer being configured to dry a paper web, the Yankee hood having an air inlet for receiving heated air for removing moisture from the web and an air outlet for exhausting the moisture-containing air from the drying device, a web handling device disposed upstream of the drying device and configured to interact with the web, the web being carried by a fabric, before the web is directed to the drying device, and a vacuum system for producing a suction, said method comprising:

directing a portion of the moisture-containing air from the air outlet of the drying device comprising the Yankee dryer to the web handling device, and through the web and the fabric to the vacuum system.

21. A method according to claim 20 further comprising volumetrically contracting the moisture-containing air while condensing the moisture therefrom to thereby increase the suction produced by the vacuum system, after directing the moisture-containing air from the web handling device to the vacuum system.

22. A method according to claim 21 further comprising producing the suction with a liquid ring pump using a flow of seal water provided by a cooling tower.

23. A method according to claim 22 further comprising emitting a water spray from a water spray device into engagement with the moisture-containing air from the web handling device, the cooling tower providing water to the water spray device, so as to volumetrically contract the air while condensing the moisture therefrom.

24. A method according to claim 22 further comprising increased the flow of seal water to the liquid ring pump so as to volumetrically contract the moisture-containing air from the web handling device directed therethrough while condensing the moisture therefrom.

25. A method according to claim 20 wherein directing a portion of the moisture-containing air from the air outlet of the drying device comprising the Yankee dryer, further comprises directing a portion of the moisture-containing air from the air outlet of the drying device comprising the Yankee dryer, wherein the drying device also comprises at least one of a through-air dryer and an impingement dryer.

26. A method according to claim 20 wherein directing the portion of the moisture-containing air from the air outlet of the drying device comprising the Yankee dryer further comprises directing the portion of the moisture-containing air from the air outlet of the drying device comprising the Yankee dryer to at least one of a vacuum box, a molding box, and a hot air supply device.

27. A method according to claim 20 further comprising forming the web on the fabric, the fabric comprising a forming fabric configured to transport the web through the web handling device.

28. A method according to claim 27 wherein directing the portion of the moisture-containing air from the air outlet of the drying device comprising the Yankee dryer further comprises directing the portion of the moisture-containing air from the air outlet of the dying device comprising the Yankee dryer to a hot air supply device having a hot air supply hood and a vacuum box in communication with the vacuum system, the hot air supply device being configured such that the moisture-containing air is directed by the hot air supply hood through the web, before the moisture-containing air is directed through the forming fabric and into the vacuum box.

29. A method according to claim 27 wherein forming the web on the fabric further comprises forming the web on a through-air drying (TAD) fabric.

30. A method according to claim 20 wherein the fabric further comprises a drying fabric for receiving the web from a forming fabric having the web formed thereon, and wherein directing the portion of the moisture-containing air from the air outlet of the drying device comprising the Yankee dryer, further comprises directing the portion of the moisture-containing air from the air outlet of the drying device comprising the Yankee dryer through the forming fabric, the web, and the drying fabric and into a vacuum box disposed adjacent to the drying fabric.

31. A method according to claim 30 wherein directing the portion of the moisture-containing air through the web further comprises directing the portion of the moisture-containing air through the web by providing the suction at the vacuum box with the vacuum system, the suction being sufficient to pull the moisture-containing air through the forming fabric, the web, and the drying fabric and into the vacuum box.

32. A method according to claim 20 wherein the fabric further comprises a drying fabric configured to transport the web thereon to the drying device and the web handling device further comprises a molding box in communication with the vacuum system and disposed adjacent to the drying fabric, and wherein directing the portion of the moisture-containing air through the web further comprises directing the portion of the moisture-containing air through the web and the drying fabric and into the molding box.

33. A method according to claim 32 wherein the drying device further comprises a through-air dryer having a drying cylinder at least partially covered by a hood extending upstream of the drying cylinder so as to at least partially oppose the molding box, and wherein directing the portion of the moisture-containing air through the web further comprises directing the portion of the moisture-containing air into the hood generally opposite to the molding box, through the web and the drying fabric, and into the molding box.

34. A method according to claim 20 wherein the papermaking machine further comprises an air handling device for providing heated air to the drying device for drying the web, the air handling device having an air inlet for receiving air to be heated and an air outlet in communication with the air inlet of the drying device comprising the Yankee dryer for directing the heated air to the drying device, and wherein the method further comprises directing a mixture of a portion of the heated air from the air outlet from the air handling device and the portion of the moisture-containing air from the drying device comprising the Yankee dryer to the web-handling device.

35. A method according to claim 34 wherein directing a mixture of a portion of the heated air from the air outlet from the air handling device and the portion of the moisture-containing air from the drying device comprising the Yankee dryer to the web-handling device further comprises directing a mixture of about 10% of the heated air from the air outlet from the air handling device and the portion of the moisture-containing air from the drying device comprising the Yankee dryer to the web-handling device.

36. A method according to claim 34 wherein directing a mixture of a portion of the heated air from the air outlet from the air handling device and the portion of the moisture-containing air from the drying device comprising the Yankee dryer to the web-handling device further comprises directing a mixture of a portion of the heated air from the air outlet from the air handling device and about 10% of the moisture-containing air from the drying device comprising the Yankee dryer to the web-handling device.

37. A method according to claim 20 further comprising adjusting a condition or the portion of the moisture-containing air from the drying device comprising the Yankee dryer with a conditioning device before directing the portion of the moisture-containing air to the web handling device.

38. A method according to claim 20 further comprising directing the remainder of the moisture-containing air from the air outlet of the drying device comprising the Yankee dryer to be recirculated through the drying device comprising the Yankee dryer such that substantially none of the moisture-containing air from the drying device is vented to atmosphere.

39. An apparatus for increasing dewatering efficiency of a paper web in a papermaking machine, said apparatus comprising:

a drying device configured to dry the web, the drying device having an air inlet for receiving heated air for removing moisture from the web and an air outlet for exhausting the moisture-containing air from the drying device;

an air handling device for providing heated air, the air handling device having an air inlet for receiving incoming air to be heated and an air outlet in communication with the air inlet of the drying device for directing the heated air thereto; and a web handling device disposed upstream of the drying device and configured to interact with the web before the web is directed to the drying device, the web handling device being configured to receive a mixture of a portion of the heated air from the air outlet of the air handling device and the portion of the moisture-containing air from the air outlet of the drying device for facilitating dewatering of the web, the web handling device being further configured to interact with the web at an above-ambient pressure.

40. An apparatus according to claim 39 wherein the drying device comprises a least one of a through-air dryer, an impingement dryer, and a Yankee dryer.

41. An apparatus according to claim 39 wherein the web handling device comprises at least one of a vacuum box, a molding box, and a hot air supply device.

42. An apparatus according to claim 39 further comprising a former for forming the web on a forming fabric configured to transport the web through the web handling device, the web-handling device comprising a hot air supply device having a hot air supply hood and a vacuum box in communication with the vacuum system, the hot air supply device being configured such that the mixture of air is channeled by the hot air supply hood through the web, before the mixture of air is directed through the forming fabric to the vacuum box, the hot air supply hood and vacuum box being configured such that the hot air supply device operates at an above-ambient pressure.

43. An apparatus according to claim 42 wherein the forming fabric comprises a through-air drying (TAD) fabric.

44. An apparatus according to claim 39 further comprising a drying fabric configured to receive the web from a forming fabric having the web formed thereon, the web handling device comprising a vacuum box in communication with the vacuum system and disposed adjacent to the drying fabric the web handling device being configured such that the mixture of air is channeled through the forming fabric and through the web, before being directed through the drying fabric and into the vacuum box.

45. An apparatus according to claim 39 further comprising a drying fabric configured to transport the web thereon to the drying device, the web handling device further comprising a molding box in communication with the vacuum system and disposed adjacent to the drying fabric, tho web handling device being configured such that the mixture of air is channeled through the web, before being directed through the drying fabric and into the molding box.

46. An apparatus according to claim 45 wherein the drying device further comprises a through-air dryer having a drying cylinder at least partially covered by a hood and wherein the hood extends upstream of the drying device so as to at least partially oppose the molding box.

47. An apparatus according to claim 46 wherein the portion of the moisture-containing air from the air outlet of the drying device is directed from the through-air dryer and mixed with the portion of the air from the air outlet of the air handling device before being channeled into the hood generally opposite to the molding box.

48. An apparatus according to claim 39 wherein the air handling device is further configured to receive the remainder of the moisture-containing air from the air outlet of the drying device through the air inlet thereof for recirculation through the drying device, thereby substantially eliminating venting of exhaust air from the drying device to atmosphere.

49. An apparatus according to claim 39 wherein the portion of the moisture-containing air comprises about 10% of the moisture-containing air from the air outlet of the drying device.

50. An apparatus according to claim 39 wherein the portion of the air from the air outlet of the air handling device comprises about 10% of the air from the air outlet of the air handling device.

51. An apparatus according to claim 39 further comprising a conditioning device for adjusting a condition of the mixture of air before channeling the mixture of air to the web handling device.

52. An apparatus according to claim 39 further comprising a vacuum system for producing a suction, the vacuum system being further configured to receive the mixture of air from the web handling device, following dewatering of the web thereby, and to volumetrically contract the air while condensing the moisture therefrom, the volumetrically-contracted air thereby increasing the suction produced by the vacuum system.

53. An apparatus according to claim 52 wherein the vacuum system further comprises a liquid ring pump using a flow of seal water for producing the suction, and a cooling tower for conditioning the seal water.

54. An apparatus according to claim 53 wherein the cooling tower is further configured to supply water to a water spray device for emitting a water spray into engagement with the mixture of air from the web handling device, the water spray being configured to volumetrically contract the air while condensing the moisture therefrom.

55. Art apparatus according to claim 53 wherein the mixture of air from the web handling device is directed through the liquid ring pump and the liquid ring pump is configured to use an increased flow of seal water to volumetrically contract the air while condensing the moisture therefrom.

56. A method of increasing dewatering efficiency of a paper web in a papermaking machine, the papermaking machine including a drying device configured to dry a paper web, the drying device having an air inlet for receiving heated air for removing moisture from the web and an air outlet for exhausting the moisture-containing air from the drying device, an air handling device having an air inlet for receiving incoming air to be heated and an air outlet for directing the heated air to the drying device, and a web handling device disposed upstream of the drying device an configured to interact with the web before the web is directed to the drying device, said method comprising:

directing a portion of the moisture-containing air from the air outlet of the drying device;

directing a portion of the heated air from the air outlet of the air handling device to be mixed with the portion of the moisture-containing air front the drying device;

directing the mixture of air to the web handling device; and directing the mixture or air through the web at the web handling device so as to facilitate dewatering of the web, the web handling device operating at an above-ambient pressure.

57. A method according to claim 56 further comprising directing the mixture of air from the web handling device to a vacuum system configured to produce a suction.

58. A method according to claim 57 further comprising volumetrically contracting the mixture of air while condensing the moisture therefrom to thereby increasing the suction produced by the vacuum system.

59. A method according to claim 57 further comprising producing the suction with a liquid ring pump using a flow of seal water provided by a cooling tower.

60. A method according to claim 59 further comprising emitting a water spray from a water spray device into engagement with the mixture of air from the web handling device, the cooling tower providing water to the water spray device, so as to volumetrically contract the air while condensing the moisture therefrom.

61. A method according to claim 59 further comprising increasing the flow of seal water to the liquid ring pump so as to volumetrically contract the mixture of air from the web handling device directed therethrough while condensing the moisture therefrom.

62. A method according to claim 56 wherein directing a portion of the moisture-containing air from the air outlet of the drying device further comprises directing a portion of the moisture-containing air from the air outlet of the drying device comprising at least one of a through-air dryer, an impingement dryer, and a Yankee dryer.

63. A method according to claim 56 wherein directing the mixture of air to the web handling device further comprises directing the mixture of air to at least one of a vacuum box, a molding box, and a hot air supply device.

64. A method according to claim 56 further comprising forming the web on a forming fabric configured to transport the web through the web handling device.

65. A method according to claim 64 wherein directing the mixture of air to the web handling device further comprises directing the mixture of air to a hot air supply device having a hot air supply hood and a vacuum box in communication with the vacuum system, the hot air supply device being configured such that the mixture of air is directed by the hot air supply hood and through the web before the mixture of air is directed through the forming fabric to the vacuum box, the hot air supply hood and vacuum box being configured such that the hot air supply device operates at an above-ambient pressure.

66. A method according to claim 64 wherein forming the web on a forming fabric further comprises forming the web on a through-air drying (TAD) fabric.

67. A method according to claim 56 wherein the papermaking machine further comprises a drying fabric for receiving the web from a forming fabric having the web formed thereon, and wherein directing the mixture of air to the web handling device further comprises directing the mixture of air through the forming fabric, the web, and the drying fabric and into a vacuum box disposed adjacent to the drying fabric.

68. A method according to claim 67 wherein directing the mixture of air through the web further comprises directing the mixture of air through the web by providing the suction at the vacuum box with the vacuum system, the suction being sufficient to pull the mixture of air through the forming fabric, the web, and the drying fabric and into the vacuum box.

69. A method according to claim 56 wherein the papermaking machine further comprises a drying fabric configured to transport the web thereon to the drying device and the web handling device further comprises a molding box in communication with the vacuum system and disposed adjacent to the drying fabric, and wherein directing the mixture of air through the web further comprises directing the mixture of air through the web and the drying fabric and into the molding box.

70. A method according to claim 69 wherein the drying device further comprises a through-air dryer having a drying cylinder at least partially covered by a hood extending upstream of the drying cylinder so as to at least partially oppose the molding box, and wherein directing the mixture of air through the web further comprises directing the mixture of air into the hood generally opposite to the molding box, through the web and the drying fabric and into the molding box.

71. A method according to claim 56 wherein directing the portion of the moisture-containing air from the air outlet of the drying device further comprises directing about 10% of the moisture-containing air from the air outlet of the drying device.

72. A method according to claim 56 wherein directing a portion of the heated air from the air outlet of the air handling device further comprises directing about 10% of the heated air from the air outlet of the air handling device to be mixed with the portion of the moisture-containing air from the air outlet of the drying device.

73. A method according to claim 56 further comprising adjusting a condition of the mixture of air with a conditioning device before directing the mixture of air to the web handling device.

74. A method according to claim 56 further comprising directing the remainder of the moisture-containing air from the air outlet of the drying device to the air inlet of the air handling device for recirculation through the drying device such that substantially none of the moisture-containing air from the drying device is vented to atmosphere.

* * * * *

UNITED STATES PATENT AND TRADEMARK OFFICE

CERTIFICATE OF CORRECTION

PATENT NO. : 6,869,506 B2
DATED : March 22, 2005
INVENTOR(S) : Dennis Edward Jewitt It is certified that error appears in the above-identified patent and that said Letters Patent is hereby corrected as shown below:

Title page,
Item [56], References Cited, U.S. PATENT DOCUMENTS, "6,306,257" should read -- 6,306,267 --;

Column 14,
Line 15, after the word "dryer" delete the comma ",";

Column 16,
Line 4, after the word "fabric" insert a comma -- , --;
Line 62, "Art" should read -- An --;

Column 17,
Line 10, "an" should read -- and --;
Line 17, "front" should read -- from --.

Signed and Sealed this

Thirty-first Day of May, 2005

JON W. DUDAS
*Director of the United States Patent and Trademark Office*